US005131377A

United States Patent [19]

Taruya et al.

[11] Patent Number: 5,131,377

[45] Date of Patent: Jul. 21, 1992

[54] IGNITION DEVICE FOR AN INTERNAL COMBUSTION ENGINE PROVIDED WITH AN OPTOISOLATOR

[75] Inventors: Masaaki Taruya; Mitsuru Koiwa, both of Himeji, Japan

[73] Assignee: Mitsubishi Denki Kabushiki Kaisha, Tokyo, Japan

[21] Appl. No.: 718,134

[22] Filed: Jun. 20, 1991

[30] Foreign Application Priority Data

Jun. 22, 1990 [JP] Japan ..... 2-162811

[51] Int. Cl.[5] ..... F02P 7/073

[52] U.S. Cl. ..... 123/613; 123/652

[58] Field of Search ..... 123/613, 618, 643, 651, 123/652

[56] References Cited

U.S. PATENT DOCUMENTS 3,868,938 3/1975 Trass ..... 123/613
4,122,814 10/1978 Ford ..... 123/613 X
4,305,371 12/1981 Harada et al. ..... 123/613
5,002,034 3/1991 Herden et al. ..... 123/652

FOREIGN PATENT DOCUMENTS 105932 2/1976 Japan .
0108873 6/1984 Japan ..... 123/613

*Primary Examiner*—Willis R. Wolfe
*Attorney, Agent, or Firm*—Sughrue, Mion, Zinn, Macpeak and Seas

[57] ABSTRACT

The power transistor unit 2A for controlling the current supply to the primary side of the ignition coil 3 includes a light emitting diode 10 coupled to the output of the control unit 1, and a phototransistor 11 optically coupled to the light emitting diode 10. The light emitting diode 10 and the phototransistor 11 together constitute a optoisolator. Thus, the ignition coil 3 is electrically isolated from the control unit 1, and hence a filter circuit for suppressing noise from the ignition coil 3 can be dispensed with.

5 Claims, 1 Drawing Sheet

IGNITION DEVICE FOR AN INTERNAL COMBUSTION ENGINE PROVIDED WITH AN OPTOISOLATOR

BACKGROUND OF THE INVENTION

This invention relates to ignition devices for internal combustion engines, and more particularly to the circuit organization of the power transistor unit for turning on and off the current supplied to the ignition coil.

FIG. 2 is a circuit diagram of a conventional ignition device for an internal combustion engine. In FIG. 2, a control unit 1, including a CPU (not shown) for controlling a transistor 1*a*, generates an ignition signal in synchrony with the rotation of the internal combustion engine. In response to the ignition signal from the control unit 1, a power transistor unit 2 turns off the current supplied to the ignition coil 3. The power transistor unit 2 includes a filter circuit 4 consisting of a capacitor 5 and a resistor 6, and a pair of transistors 7 and 8 coupled in Darlington connection. The filter circuit 4 reduces the effect of noise on the signal lines, which is induced, for example, by the reflection voltage of the ignition coil 3. Thus, the filter circuit 4 suppresses the interference of the ignition coil 3 on the control unit 1.

The operation of the conventional ignition device of FIG. 2 is as follows. When the CPU turns on the transistor 1*a* to turn off the transistors 7 and 8, the current flowing through the primary side of the ignition coil 3 is interrupted and thus a high voltage is induced at the secondary side of the ignition coil 3. The high voltage thus induced at the secondary side of the ignition coil 3 is supplied to the ignition plug (not shown) of the internal combustion engine.

The above conventional ignition device has the following disadvantage. The power transistor unit 2 includes, in addition to the transistors 7 and 8, the filter circuit 4 consisting of the capacitor 5 and the resistor 6. Thus, the number of necessary parts are multiplied and the structure is thereby complicated. This increases the production cost of the device.

SUMMARY OF THE INVENTION

It is therefore an object of this invention to provide an ignition device for an internal combustion engine by which the number of circuit parts is reduced, the circuit structure is simplified, and the production cost is reduced.

The above objects are accomplished in accordance with the principle of this invention by an ignition device for an internal combustion engine which comprises: means for generating an electrical signal in synchrony with a rotation of an internal combustion engine; means for converting said electrical signal into an optical signal; and a photoconductive switching element means, optically coupled to said converting means and electrically coupled in series with a primary side of said ignition coil, for turning on and off a current supply to said ignition coil in response to said optical signal.

Preferably, the light emitting means comprises a light emitting diode which is turned off in response to the ignition signal generated at an ignition timing of the internal combustion engine. Further, the photoconductive switching element means preferably comprises a phototransistor, constituting an optoisolator together with the light emitting diode and coupled in series with the primary side of the ignition coil, which phototransistor is turned off in response to the ignition signal to interrupt the current supply to the primary side of the ignition coil, thereby generating a high voltage at the secondary side of the ignition coil.

BRIEF DESCRIPTION OF THE DRAWINGS

The features which are believed to be characteristic of this invention are set forth with particularity in the appended claims. The structure and method of operation of this invention itself, however, will be best understood from the following detailed description, taken in conjunction with the accompanying drawings, in which:

In the drawings, like reference numerals represent like or corresponding parts or portions.

DETAILED DESCRIPTION OF THE PREFERRED EMBODIMENTS

Referring now to the accompanying drawings, the preferred embodiments of this invention are described.

Figure 1:
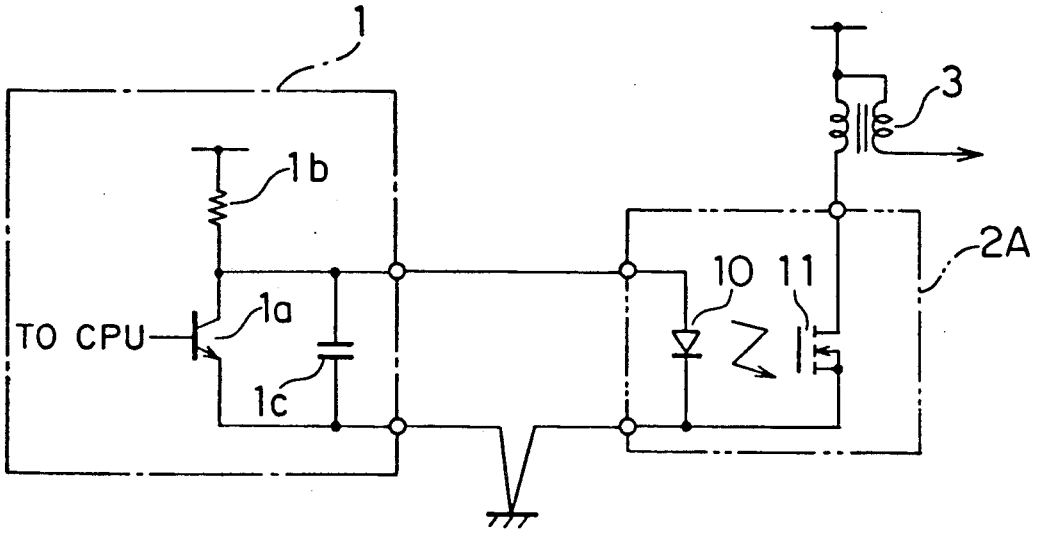
FIG. 1 is a circuit diagram of an ignition device for an internal combustion engine according to this invention.

FIG. 1 is a circuit diagram of an ignition device for an internal combustion engine according to this invention. As in the case of the conventional ignition devices, the control unit 1 includes a CPU or a microprocessor (not shown) for controlling the operation of the internal combustion engine. The CPU thus controls the on/off of the transistor 1*a* in synchrony with the rotation of the internal combustion engine. The transistor 1*a* is coupled across a voltage source and the ground via a resistor 1*b*. A capacitor 1*c* is coupled in parallel with the transistor 1*a*.

The power transistor unit 2A for controlling the current supply to the ignition coil 3 includes a light emitting diode 10 coupled across the transistor 1*a* of the control unit 1, and a photoconductive semiconductor switching element such as a phototransistor 11 optically coupled to the light emitting diode 10. The light emitting diode 10 and the phototransistor 11 constitute an optoisolator.

The operation of the ignition device of FIG. 1 is as follows. When the output from the CPU to the base of the transistor 1*a* is at the low level, the light emitting diode 10 is supplied via the resistor 1*b* with a current from the voltage source, and the light emitting diode 10 emits light therefrom. In response thereto, the phototransistor 11 is turned on, such that a current flows through the primary side of the ignition coil 3 via the phototransistor 11.

At the ignition timing, the CPU turns on the transistor 1*a*, thereby turning off the light emitting diode 10. Thus, the phototransistor 11 is also turned off, to interrupt the current flowing through the primary side of the ignition coil 3. As a result, a high voltage is induced at the secondary side of the ignition coil 3, which high voltage is supplied to an ignition plug of the internal combustion engine via a distributor (not shown).

Figure 2:
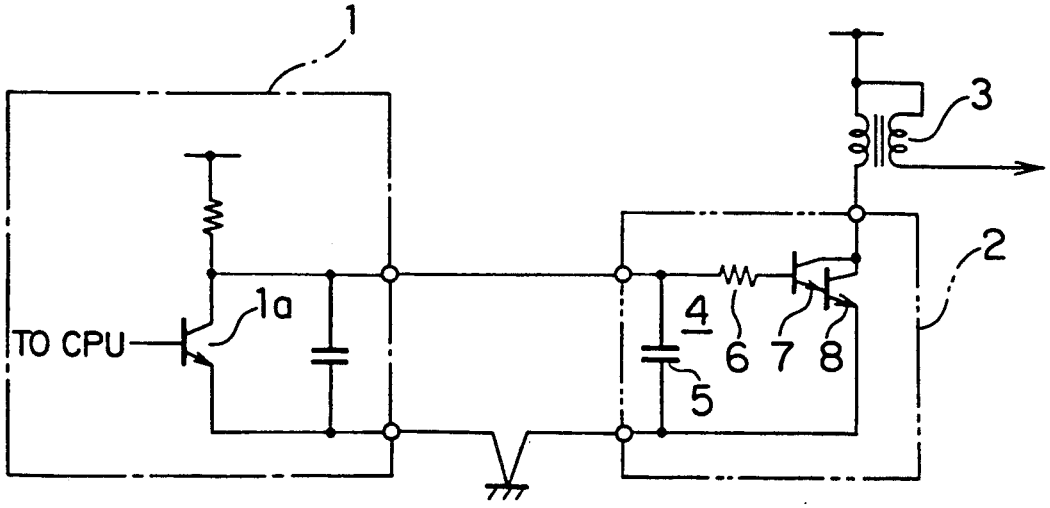
FIG. 2 PRIOR ART
FIG. 2 is a circuit diagram of a conventional ignition device for an internal combustion engine.

Since the optoisolator consisting of the light emitting diode 10 and the phototransistor 11 isolates the control unit 1 from the adverse effects of noises resulting from the reflection voltage, etc., of the ignition coil 3, the filter circuit (such as the filter circuit 4 of FIG. 2) for suppressing noise is not necessary. Thus, the number of circuit parts and hence the production cost can be reduced. Further, the operation can be rendered more reliable.

What is claimed is:

1. An ignition device for turning on and off a current supply to a primary winding of an ignition coil of an internal combustion engine, said ignition device comprising:

means for generating an electrical ignition timing signal in synchronism with a rotation of said internal combustion engine;

a single means for converting said electrical ignition timing signal into an optical signal; and a single photoconductive switching element, exclusively optically coupled to said converting means and electrically connected in series with said primary winding of said ignition coil, for turning on and off a current supply to said primary winding of said ignition coil in response to said optical signal.

2. An ignition device as claimed in claim 1, wherein said converting means comprises a light emitting element coupled to said electrical ignition timing signal generating means, said light emitting element being turned off in response to an ignition timing signal generated by said electrical ignition timing signal generating means at an ignition timing of said internal combustion engine, and the photoconductive switching element turns off the current supply to the primary winding of the ignition coil in response to the ignition timing signal, thereby inducing a high voltage in a secondary winding of the ignition coil.

3. An ignition device as claimed in claim 2, wherein said light emitting element comprises a light emitting diode.

4. An ignition device as claimed in claim 3, wherein said photoconductive switching element means comprises a phototransistor optically coupled with said light emitting diode.

5. An ignition device as claimed in claim 4, wherein the light emitting diode and the phototransistor are embodied in a unitary optoisolator structure.

* * * * *